US005944501A

United States Patent [19]

Yokoi

[11] Patent Number: 5,944,501

[45] Date of Patent: Aug. 31, 1999

[54] ROOTS BLOWER HAVING ZIGZAG MEANDERING GROOVES IN THE CASING INNER WALL SURFACE

[75] Inventor: Yasuna Yokoi, Aichi-Ken, Japan

[73] Assignee: Anlet Co., Ltd., Aichi, Japan

[21] Appl. No.: 08/872,211

[22] Filed: Jun. 10, 1997

[30] Foreign Application Priority Data

Jun. 28, 1996 [JP] Japan ..... 8-188224

[51] Int. Cl.[6] ..... F04C 18/18; F04C 29/06

[52] U.S. Cl. ..... 418/181; 418/206.1

[58] Field of Search ..... 418/15, 180, 181, 418/206.1, 206.4; 417/312

[56] References Cited

U.S. PATENT DOCUMENTS 4,781,541 11/1988 Sohler et al. ..... 418/206.1

FOREIGN PATENT DOCUMENTS 3124986 5/1991 Japan ..... 418/181

*Primary Examiner*—John J. Vrablik

*Attorney, Agent, or Firm*—Koda & Androlia

[57] ABSTRACT

A Roots blower includes a casing having an inlet port and an outlet port, and a pair of multi-lobed rotors mounted for rotation in the casing. The rotors are rotated in such a manner that communication between the inlet and outlet ports is cut off, so that air is drawn in through the inlet port and the drawn air is discharged through the outlet port without being compressed. Two sets of zigzag meandering grooves are formed on an inner peripheral wall surface of the casing. Each set includes a plurality of zigzag meandering grooves zigzag extending in rotation directions of the rotors over two regions of the inner peripheral wall surface of the casing spreading from locations corresponding to apexes of front lobes of the rotors to the outlet port with respect to the rotation directions of the rotors when communication between the inlet port and chambers defined by the front lobes, rear lobes and the inner peripheral wall surface of the casing is cut off by the rear lobes with respect to the rotation directions of the rotors, respectively.

3 Claims, 8 Drawing Sheets

GRAPHS SHOWING THE RESULTS OF ANALYSIS OF SOUND FREQUENCIES

| PRESENT INVENTION | COMPARED CASE 1 |
|---|---|
   LOCATION P1 | Fig.7E   LOCATION P1 |
   P2 | Fig.7F   P2 |
   P3 | Fig.7G   P3 |
   P4 | Fig.7H   P4 |

GRAPH SHOWING THE CHANGES IN THE RESIDUAL PRESSURE IN THE CASING

ROOTS BLOWER HAVING ZIGZAG MEANDERING GROOVES IN THE CASING INNER WALL SURFACE

BACKGROUND OF THE INVENTION

1. Field of the Invention

This invention relates generally to Roots blowers suitable to use for aeration in river-basin sewerage or small waste water disposal facilities, transportation of powder, etc., and more particularly to such a Roots blower in which a noise produced during its operation can be reduced.

2. Description of the Prior Art

Conventional Roots blowers of the positive displacement type comprise a casing formed to have a generally oval cross section and having an inlet port and an outlet port, and a pair of rotors mounted on parallel shafts in the casing to be rotated in opposite directions. Each rotor has a multilobed structure. Upon rotation of the rotors, chambers are defined by an inner peripheral wall surface of the casing and lobes of the rotors respectively. It is known in the art that in the Roots blowers of the above-described type, supercharged suction air flows backward from the outlet port side to each chamber through a small clearance between each rotor and the casing at an initial stage of delivery stroke. It is also known that such a backflow of the suction air produces noise. To reduce the noise due to the backflow, the assignee of the present application proposed, in Japanese Utility Model Publication No. 49-63507 published on Jun. 4, 1974, a Roots blower provided with straight grooves formed on an inner peripheral wall surface of the casing to extend along a rotation direction of each rotor. The assignee further proposed, in Japanese Patent Publication No. 3-124986 published on May 28, 1991, another Roots blower provided with helical grooves formed on the inner peripheral wall surface of the casing at a predetermined angle to an imaginary line parallel with each rotor axis.

Furthermore, Japanese Utility Model Publication No. 62-173579 published on Nov. 4, 1987 discloses a supercharger comprising a rotor housing having an inlet port and an outlet port, and a pair of two-lobed rotors rotatably mounted on respective shafts in the rotor housing. The rotor housing has two sets of straight grooves each of which sets includes a plurality of straight grooves formed on the inner peripheral wall surface of the casing to be parallel with axes of the rotors. The straight grooves of each set are formed to extend from a location on the inner peripheral wall surface of the casing corresponding to an apex of a front lobe with respect to the rotation direction of each rotor to the outlet port when communication between the inlet port and a chamber defined by the front lobe, rear lobe and the inner peripheral wall surface of the casing is cut off by the rear lobe with respect to the rotation direction of the rotor, whereby noise reduction is improved.

However, the noise reduction provided by each of the above-described Roots blowers and supercharger is insufficient. Further noise reduction has been desired for an improvement in residential or workshop environment. Furthermore, the Roots blower needs to be of small size and to have a high-speed rotation structure from the viewpoint of its production cost. However, since this structure has resulted in an increase in the operation noise, the noise reduction has technically been difficult in the prior art.

SUMMARY OF THE INVENTION

Therefore, an object of the present invention is to provide an improved Roots blower in which the noise produced during the operation can effectively be reduced.

To accomplish the object, the present invention provides a Roots blower comprising a casing having an inlet port and an outlet port, and a pair of multi-lobed rotors mounted for rotation in the casing, the rotors being rotated in such a manner that communication between the inlet and outlet ports is cut off, thereby drawing in air through the inlet port, the drawn air being discharged through the outlet port without being compressed. Two sets of zigzag meandering grooves each including a plurality of zigzag meandering grooves are formed on an inner peripheral wall surface of the casing. The two sets of meandering grooves zigzag extend in rotation directions of the rotors over two regions of the inner peripheral wall surface of the casing spreading from locations corresponding to apexes of front lobes of the rotors to the outlet port with respect to the rotation directions of the rotors when communication between the inlet port and chambers defined by the front lobes, rear lobes and the inner peripheral wall surface of the casing is cut off by the rear lobes with respect to the rotation directions of the rotors, respectively.

Chambers are defined by the inner peripheral wall surface of the casing and the front and rear lobes of the rotors with respect to the rotation directions of the respective rotors. Each chamber communicates with the outlet port via each set of the meandering grooves when the apex of the front lobe of each rotor passes over each set of the meandering grooves. Accordingly, air flows backward from the outlet port side to each chamber side. The direction of the backflow air tending to go straight ahead is changed between the opposite directions of the meandering grooves repeatedly alternately when the air passes through the meandering grooves, whereupon the flow velocity of the air is gradually reduced. Furthermore, the air collides with side walls of the meandering grooves, resulting in a turbulent flow which limits an increase in the pressure. Consequently, the noise produced by the turbulent flow is reduced such that production of an offensive, uncomfortable sound can be prevented. The Roots blower of the present invention can reduce the operation noise due to the air flowing backward from the outlet port side to each chamber side by about 7 to 10 dB as compared with the prior art Roots blowers.

Each meandering groove preferably includes a plurality of sections inclined alternately in opposite directions. Furthermore, the inclined sections inclined in one of the directions and the inclined sections inclined in the other direction preferably have different inclination angles from each other with respect to an imaginary line parallel to axes of the rotors on the inner peripheral wall surface of the casing. In this case, the inclination angles of the inclined sections of each meandering groove preferably range between 20 and 60 degrees. Each meandering groove may communicate with at least one adjacent meandering groove.

BRIEF DESCRIPTION OF THE DRAWINGS

Other objects, features and advantages of the present invention will become clear upon reviewing the following description of preferred embodiments thereof, made with reference to the accompanying drawings, in which:

FIGS. 7A to 7H are graphs showing the results of analysis of sound frequencies;

DETAILED DESCRIPTION OF THE PREFERRED EMBODIMENT

Figure 1:
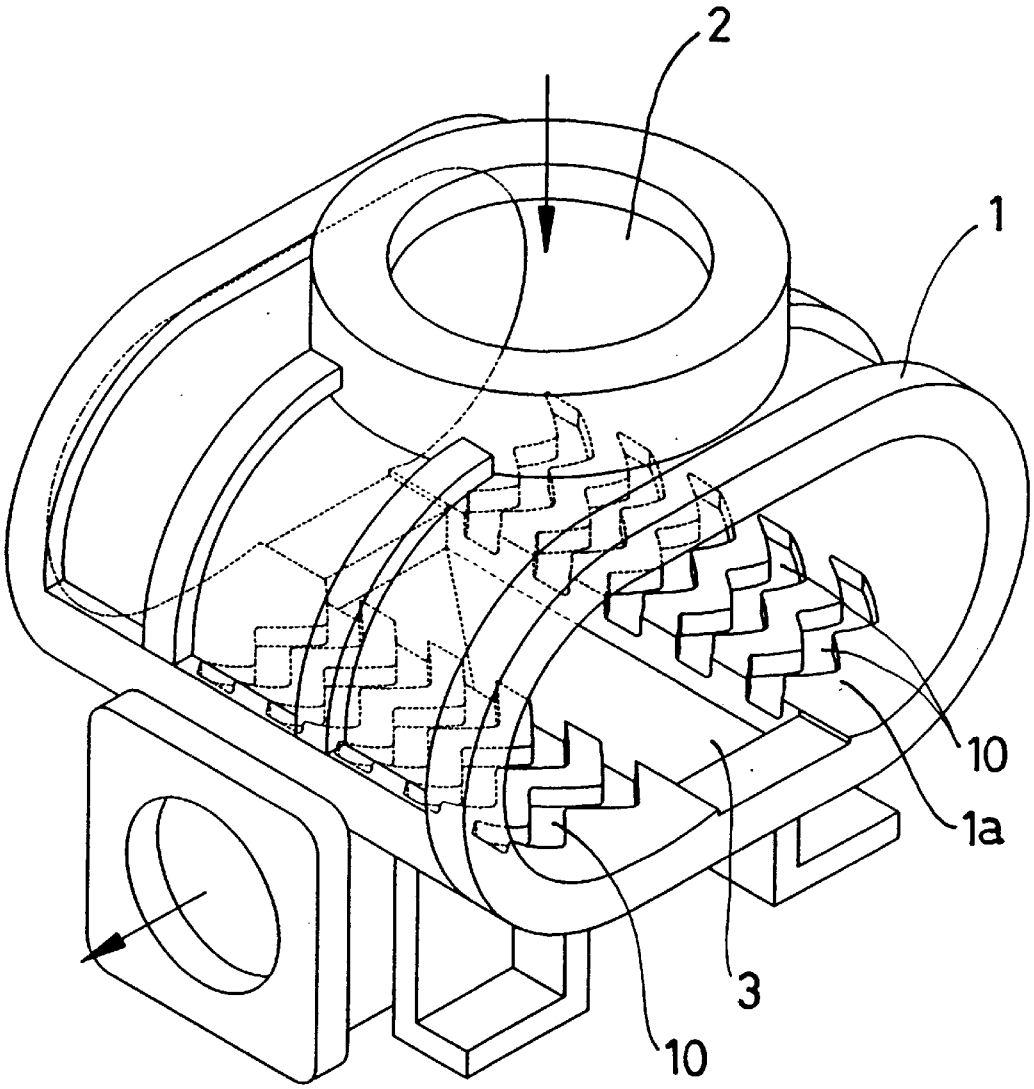
FIG. 1 is a perspective view of a casing of a three-lobed Roots blower of one embodiment in accordance with the present invention.
Figure 3:
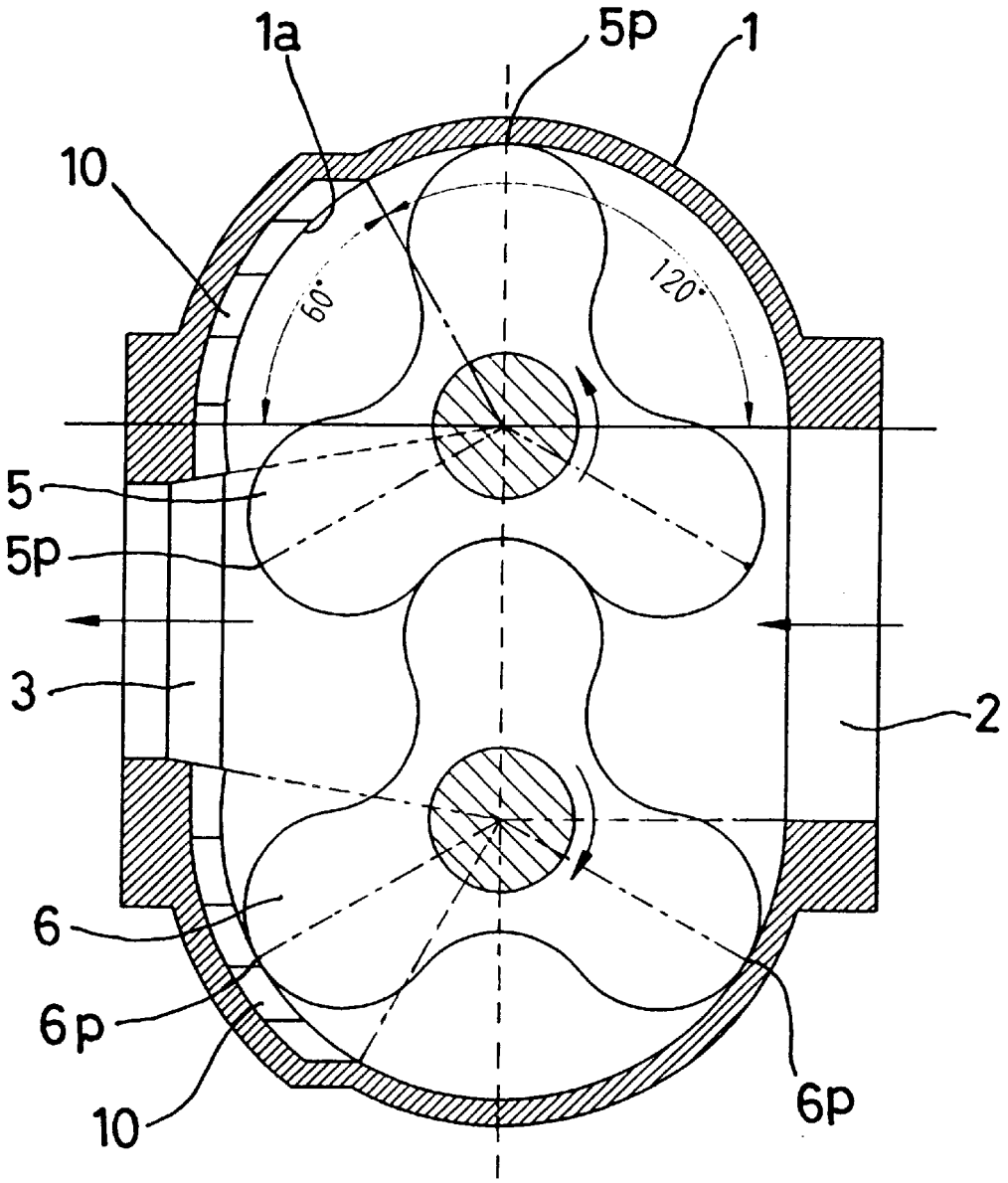
FIG. 3 is a longitudinally sectional side view of the Roots blower.
Figure 4:
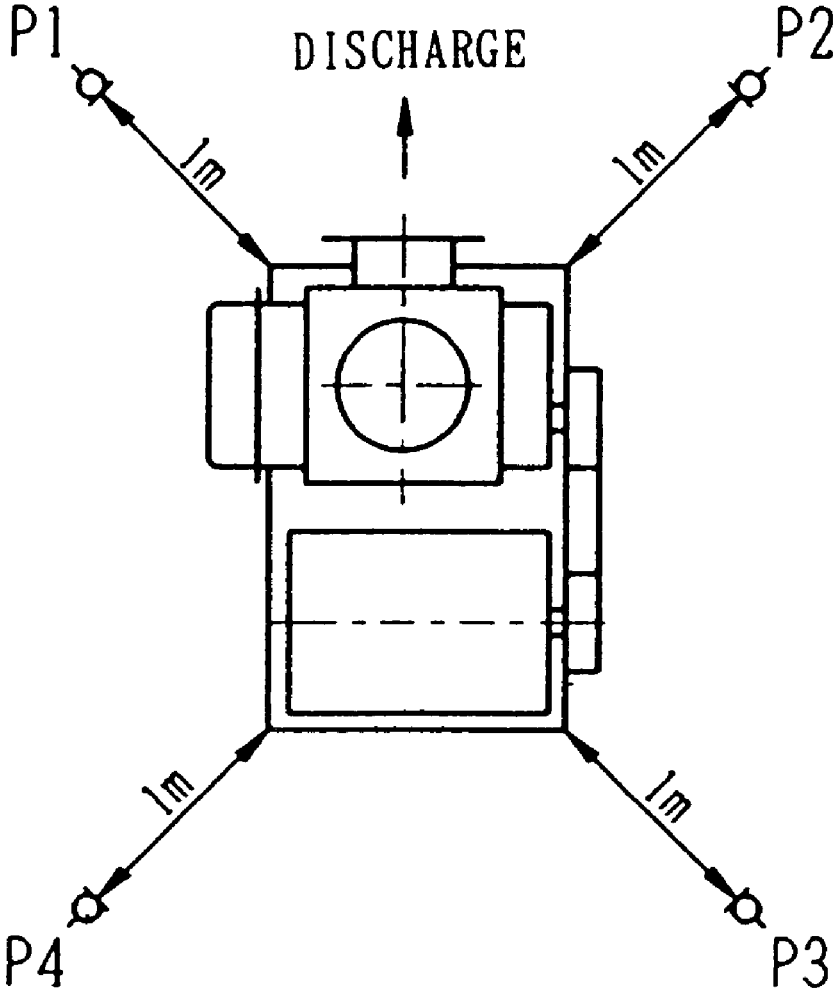
FIG. 4 is a schematic diagram of the blower, showing locations of noise measurement.

One embodiment of the present invention will be described with reference to the accompanying drawings. Referring to FIG. 1, a casing 1 of a three-lobed Roots blower embodying the invention is shown. The casing 1 has an inlet port 2 and an outlet port 3. The casing 1 encloses a pair of three-lobed rotors 5 and 6 mounted for rotation on shafts 5*a* and 6*a* respectively, as shown in FIG. 3. The rotors 5 and 6 are rotated in opposite directions so that air is drawn in through the inlet port 2 and so that the air is discharged through the outlet port 3 without being compressed.

Figure 2:
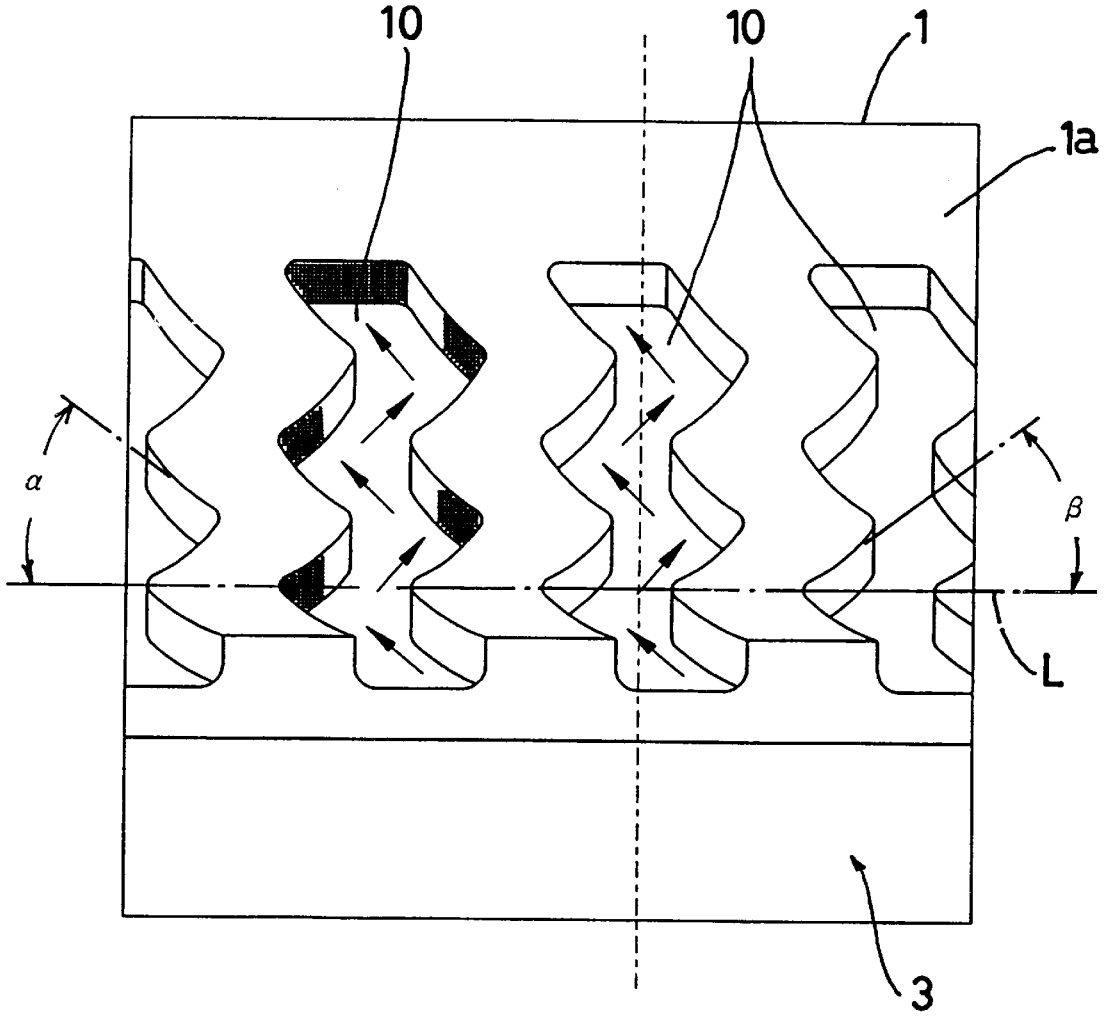
FIG. 2 is a development of zigzag meandering grooves formed on the inner peripheral wall surface of the casing.

The casing 1 has a plurality of zigzag meandering grooves 10 formed in two regions on an inner peripheral wall surface 1*a* thereof, as shown in FIGS. 1 and 2. More specifically, two rows of the zigzag meandering grooves 10 extend in rotation directions of the rotors 5 and 6 over the regions spreading from locations on the casing inner peripheral wall surface 1*a* corresponding to apexes 5*p* and 6*p* of front lobes of the rotors 5 and 6 with respect to the rotation directions of the rotors 5 and 6 to the outlet port 3 when communication between the inlet port 2 and chambers defined by the front lobes, rear lobes and the inner peripheral wall surface 1*a* of the casing 1 is cut off by the rear lobes with respect to the rotation directions of the rotors 5 and 6, respectively. Each meandering groove 10 has a predetermined depth. The regions of the meandering grooves 10 are each in a range of 60 degrees about the centers of the respective rotors 5 and 6 in the embodiment, as shown in FIG. 3.

Each meandering groove 10 includes a series of sections inclined alternately rightward and leftward, as viewed in FIG. 2. In FIG. 2, reference symbol $\alpha$ designates an inclination angle of each leftward inclined section with respect to an imaginary line L parallel to axes of the shafts 5*a* and 6*a* of the rotors 5 and 6 on the casing inner peripheral wall surface 1*a*. Reference symbol $\beta$ designates an inclination angle of each rightward inclined section with respect to the imaginary line L. The results of experiments carried out by the inventor show that the angles $\alpha$ and $\beta$ desirably range between 20 and 60 degrees. Alternatively, the inclination angles $\alpha$ and $\beta$ may be differentiated from each other. Furthermore, although each row consists of independent grooves 10 as shown in FIGS. 1 and 2, each groove 10 may communicate with one or two adjacent ones when the casing has a smaller width or when the Roots blower has a smaller discharge quantity, for example. Additionally, experimental results show that a ratio between a theoretical volume of air delivered per revolution of each rotor and a capacity of each groove 10 desirably ranges between 0.05 and 0.2.

The following experiments were carried out for confirmation of operation noise reduction in the Roots blower of the present invention.

Figure 5:
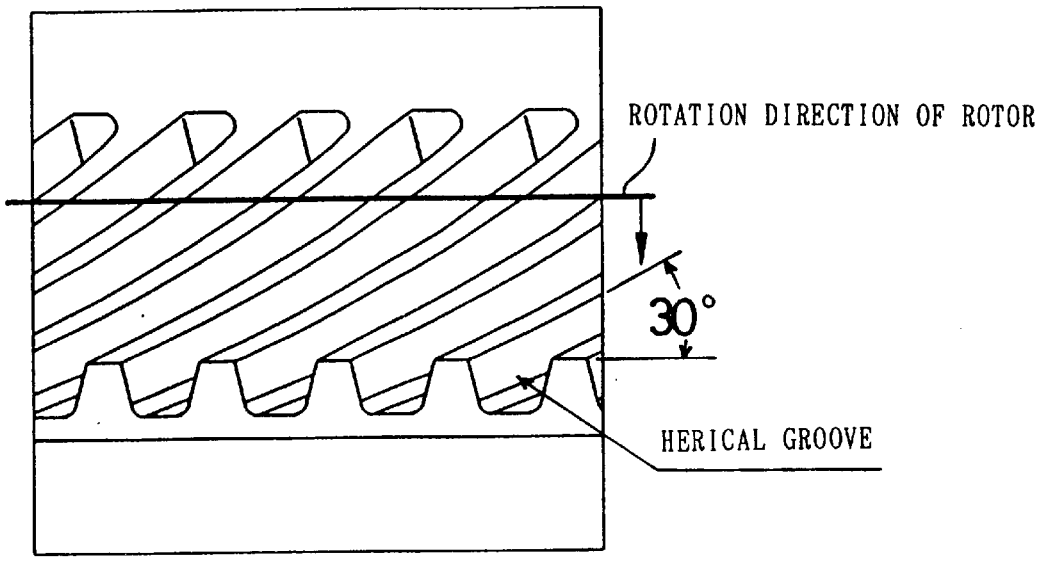
Fig. 5 PRIOR ART
FIG. 5 is a development of a helical groove in a prior art Roots blower.
Figure 6:
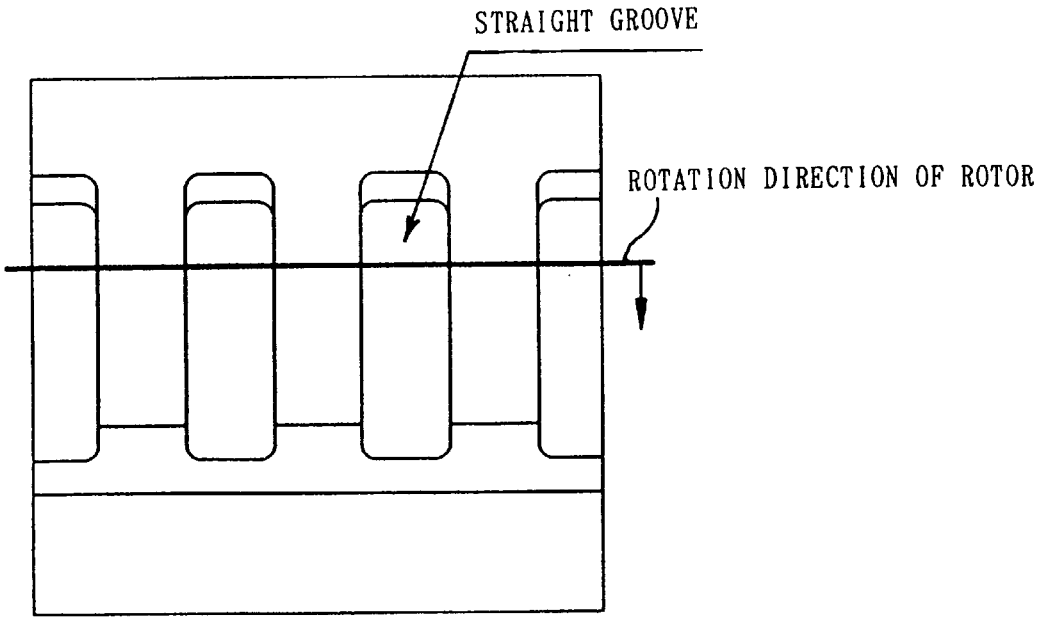
Fig. 6 PRIOR ART
FIG. 6 is a development of straight grooves in another prior art Roots blower.
Figure 7A:
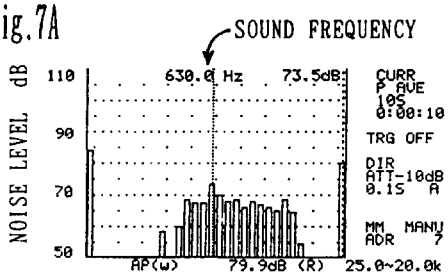
Figure 7A:
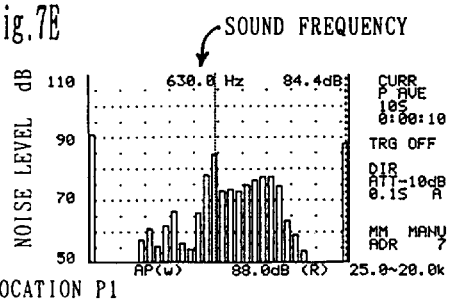
Figure 7B:
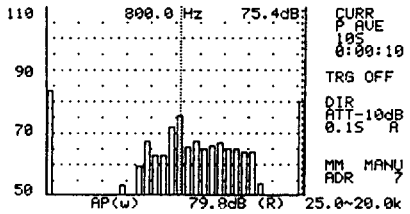
Figure 7B:
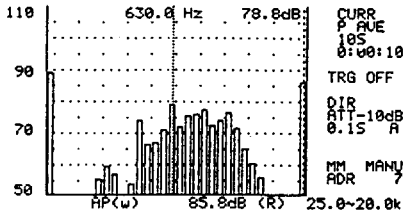
Figure 7C:
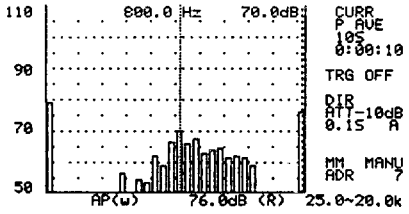
Figure 7C:
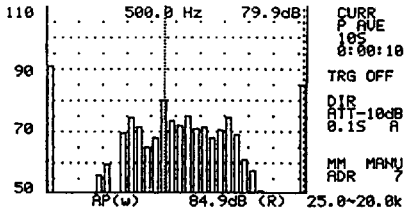
Figure 7D:
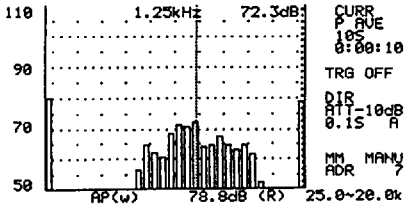
Figure 7D:
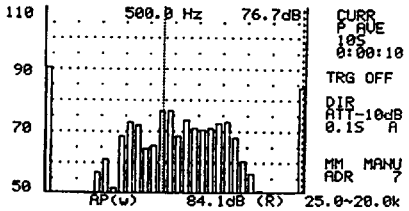

Noise measurement:

The three-lobed Roots blower used in the experiments had the bore $\phi$ of 125 mm, pressure of 0.6 Kgf/cm$^2$, discharge quantity of 13.5 m$^3$/min, rotational speed of 3,000 rpm, and power of 22 Kg. The noise was measured at four locations P1 to P4 each 1 meter away from the blower by noise meters of the NA-20 type manufactured by Lion Co., Ltd., Japan. Each of the angles $\alpha$ and $\beta$ of the meandering grooves was 45 degrees. Noise measurement was also carried out for the above-described conventional blowers as compared cases. Compared case 1 was the Roots blower disclosed in Japanese Patent Publication No. 3-124986 (1991) and having the helical grooves (FIG. 5). An inclination angle of each helical groove was set at 30 degrees. Compared case 2 was the Roots blower disclosed in Japanese Utility Model Publication No. 49-63507 (1974) and having grooves (FIG. 6) formed on the casing inner wall surface to be perpendicular to the rotation direction of the rotor. The other compared case 3 was a blower having no grooves for the noise reduction. The following TABLE 1 shows the results of the noise measurement with respect to the Roots blowers of the present invention and compared case 1.

TABLE 1

| Location of measurement | Noise level in the present invention in dB | Noise level in compared case 1 in dB |
|---|---|---|
| P1 | 79.9 | 88.0 |
| P2 | 79.8 | 85.8 |
| P3 | 76.0 | 84.9 |
| P4 | 78.8 | 84.1 |

As obvious from TABLE 1, the Roots blower of the present invention realized a noise reduction of about 7 dB (mean value) as compared with the compared case 1. The noise measurement was carried out for the Roots blowers of compared cases 2 and 3 in the same manner as described above. The measured noise level in each of compared cases 2 and 3 was higher about 10 dB than that in the present invention.

Sound frequency analysis:

Frequencies of the sound were measured at the above-mentioned locations P1–P4 by third-octave time analyzers of the SA27 type manufactured by Lion Co., Ltd. FIGS. 7A to 7D show the results of the sound frequency measurement in the Roots blower of the embodiment, whereas FIGS. 7E to 7H shows those in the Roots blower of compared case 1. FIGS. 7A–7H represent the maximum values of the sound frequencies. As obvious from these graphs, a sufficient noise insulating effect was achieved in a wider range of sound frequencies in the present invention as compared with compared case 1, and the noise was reduced accordingly in the present invention.

Figure 8:
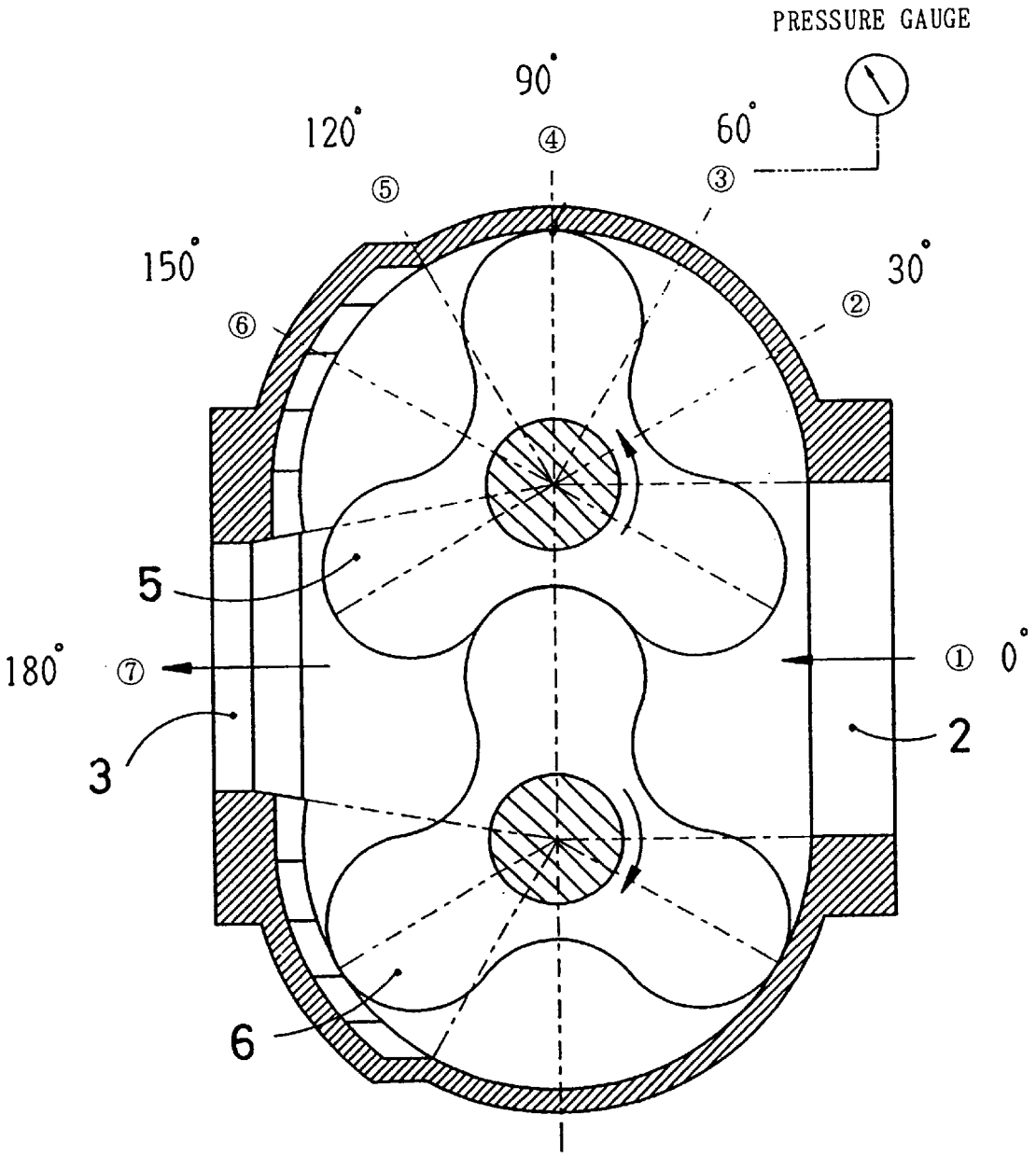
FIG. 8 is a longitudinally sectional side view of the Roots blower, showing locations of measurement of residual pressure in the casing.
Figure 9:
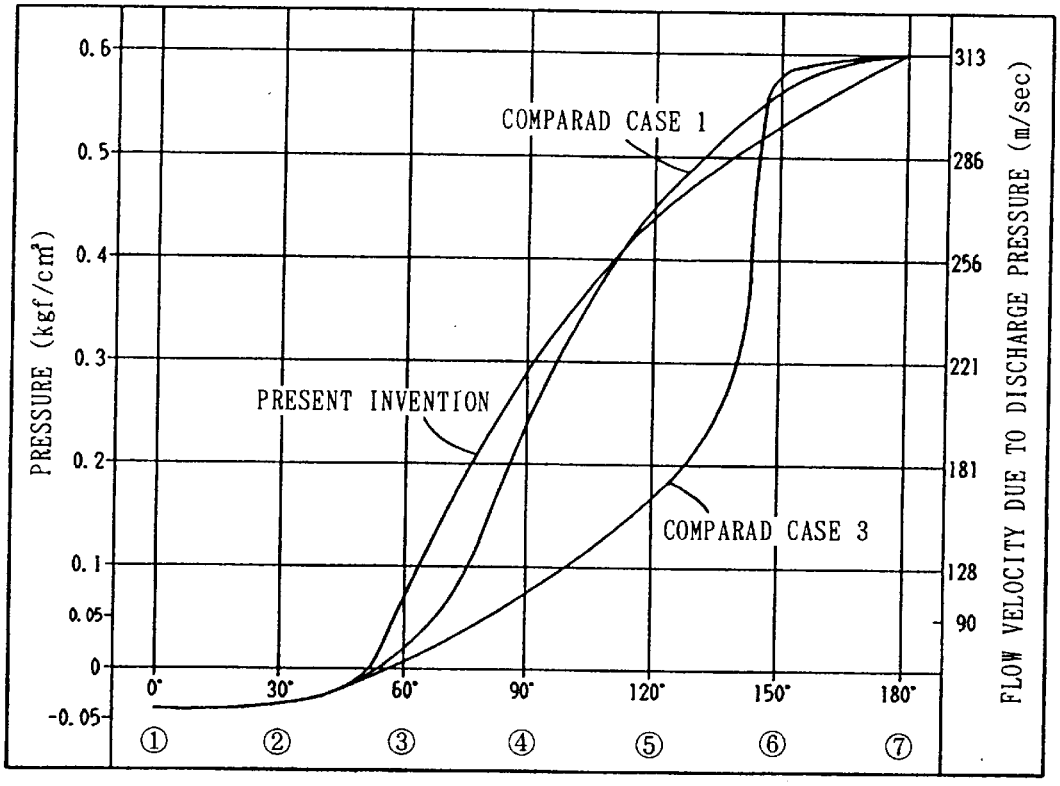
FIG. 9 is a graph showing the changes in the residual pressure in the casing.

Measurement of residual pressure in the casing:

The variations in the pressure until discharge of the drawn air were measured by pressure gauges at locations (1) to (7) corresponding to zero-degree, 30-degree, 60-degree, 90-degree, 120-degree, 150-degree and 180-degree points about the center of the rotor respectively, as shown in FIG. 8. FIG. 9 shows the results of the pressure measurement. In the present invention, the pressure was rapidly increased in a section between the 60-degree and 90-degree points. However, the pressure was low and a flow velocity of the air was low in this section. Accordingly, an amount of noise produced in this section was small. Furthermore, the pressure was gradually increased in a section between the 120-degree and 180-degree points such that the noise was restrained.

On the other hand, the pressure was rapidly increased in a section between the 90-degree and 120-degree points in compared case 1. Since the flow velocity of air was also increased in this section, a large noise reducing effect could not be achieved.

Furthermore, the residual pressure was measured regarding compared case 3 in the same manner as described above. A discharge pressure was steeply increased from about 0.18 to 0.58 $Kgf/cm^2$ in a section between the 120-degree and 150-degree points in compared case 3. Consequently, the noise was increased.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. A Roots blower comprising:

a casing having an inlet port and an outlet port;

a pair of multi-lobed rotors mounted for rotation in the casing, the rotors being rotated in such a manner that communication between the inlet and outlet ports is cut off, thereby drawing in air through the inlet port, the drawn air being discharged through the outlet port without being compressed; and two sets of zigzag meandering grooves formed on an inner peripheral wall surface of the casing, each set including a plurality of zigzag meandering grooves zigzag extending in rotation directions of the rotors over two regions of the inner peripheral wall surface of the casing spreading from locations thereon corresponding to apexes of front lobes of the rotors to the outlet port with respect to the rotation directions of the rotors when communication between the inlet port and chambers defined by the front lobes, rear lobes and the inner peripheral wall surface of the casing is cut off by the rear lobes with respect to the rotation directions of the rotors, respectively.

2. A Roots blower according to claim 1, wherein each meandering groove includes a plurality of sections inclined alternately in opposite directions and the sections inclined in one of the directions and the sections inclined in the other direction have different inclination angles from each other with respect to an imaginary line parallel to axes of the rotors on the inner peripheral wall surface of the casing.

3. A Roots blower according to claim 2, wherein the inclination angles of the inclined sections of each meandering groove range between 20 and 60 degrees.

* * * * *